US009193564B2

(12) United States Patent
Yuasa

(10) Patent No.: US 9,193,564 B2
(45) Date of Patent: Nov. 24, 2015

(54) ELEVATOR DISPLAY DEVICE WITH A METALLIC TONE FILM

(75) Inventor: Eiji Yuasa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 697 days.

(21) Appl. No.: 13/574,824

(22) PCT Filed: Feb. 24, 2011

(86) PCT No.: PCT/JP2011/054131
§ 371 (c)(1),
(2), (4) Date: Jul. 24, 2012

(87) PCT Pub. No.: WO2011/132458
PCT Pub. Date: Oct. 27, 2011

(65) Prior Publication Data

US 2012/0305342 A1 Dec. 6, 2012

(30) Foreign Application Priority Data

Apr. 23, 2010 (WO) ..... PCT/JP2010/057241

(51) Int. Cl.
*B66B 1/34* (2006.01)
*B66B 3/02* (2006.01)

(52) U.S. Cl.
CPC ..... *B66B 3/02* (2013.01)

(58) Field of Classification Search
CPC ..... B66B 3/02
USPC ..... 187/391, 393, 395, 396
See application file for complete search history.

(56) References Cited

U.S. PATENT DOCUMENTS

| | | | | |
|---|---|---|---|---|
| 5,565,661 | A * | 10/1996 | Berdich et al. | 187/395 |
| 6,227,335 | B1 * | 5/2001 | Koeppe et al. | 187/414 |
| 6,598,711 | B2 * | 7/2003 | Barmet | 187/395 |
| 6,601,679 | B2 * | 8/2003 | Crenella et al. | 187/395 |
| 6,986,408 | B2 * | 1/2006 | Takeuchi | 187/380 |
| 7,152,715 | B2 * | 12/2006 | Meyer | 187/391 |
| 7,398,865 | B2 * | 7/2008 | Felder et al. | 187/395 |
| 8,003,907 | B2 * | 8/2011 | Hoshino et al. | 200/314 |
| 8,253,548 | B2 * | 8/2012 | Oh et al. | 340/286.06 |
| 8,336,678 | B2 * | 12/2012 | Poutiainen et al. | 187/395 |
| 8,348,022 | B2 * | 1/2013 | Rusanen et al. | 187/395 |
| D705,723 | S * | 5/2014 | Saikawa et al. | D13/108 |
| D710,722 | S * | 8/2014 | Saikawa et al. | D10/108 |

FOREIGN PATENT DOCUMENTS

| | | |
|---|---|---|
| JP | 62 79185 | 4/1987 |
| JP | 9 40328 | 2/1997 |
| JP | 2004 142861 | 5/2004 |
| JP | 2004 189373 | 7/2004 |
| JP | 2007 307893 | 11/2007 |
| JP | 2009 66971 | 4/2009 |
| JP | 2009 164029 | 7/2009 |

OTHER PUBLICATIONS

International Search Report Issued May 31, 2011 in PCT/JP11/54131 Filed Feb. 24, 2011.

* cited by examiner

*Primary Examiner* — Anthony Salata
(74) *Attorney, Agent, or Firm* — Oblon, McClelland, Maier & Neustadt, L.L.P.

(57) ABSTRACT

An elevator display device has a light-emitting display unit, a resin cover, and a metallic tone film. The resin cover is disposed in front of the light-emitting display unit so as to cover the light-emitting display unit, and transmits light from the light-emitting display unit. The metallic tone film is disposed on the cover, and transmits the light from the light-emitting display unit. The metallic tone film is made of a nano-layered film that is optically designed to have a metallic sheen.

6 Claims, 5 Drawing Sheets

ELEVATOR DISPLAY DEVICE WITH A METALLIC TONE FILM

TECHNICAL FIELD

The present invention relates to an elevator display device for a landing operating panel, a car operating panel, or a position indicator, for example.

BACKGROUND ART

In conventional metallic tone decorative sheets, a mirror mode ink is printed on a transparent resin film. A transparent window portion on which the mirror mode ink is not printed is disposed on a portion that transmits light (see Patent Literature 1, for example).

CITATION LIST

Patent Literature

[Patent Literature 1]
Japanese Patent Laid-Open No. 2009-66971 (Gazette)

SUMMARY OF THE INVENTION

Problem to be Solved by the Invention

In conventional metallic tone decorative sheets such as that described above, a step of applying windowed printing on the transparent resin film is required, increasing manufacturing costs. Since the transparent window portion cannot be given a metallic tone, the entire decorative design surface cannot be given a metallic tone uniformly.

The present invention aims to solve the above problems and an object of the present invention is to provide an elevator display device that can improve decorative design by enabling an entire decorative design surface to be given a metallic tone uniformly while enabling cost reductions.

Means for Solving the Problem

In order to achieve the above object, according to one aspect of the present invention, there is provided an elevator display device including: a light-emitting display unit; a resin cover that is disposed in front of the light-emitting display unit so as to cover the light-emitting display unit, and that transmits light from the light-emitting display unit; and a metallic tone film that is disposed on the cover, that is made of a nano-layered film that is optically designed to have a metallic sheen, and that transmits the light from the light-emitting display unit.

Effects of the Invention

In an elevator display device according to the present invention, because the metallic tone film that transmits the light from the light-emitting display unit is disposed on the cover, windowed printing is not performed and the entire decorative design surface can be given a metallic tone uniformly, enabling decorative design to be improved while enabling cost reductions.

DESCRIPTION OF EMBODIMENTS

Preferred embodiments of the present invention will now be explained with reference to the drawings.

Embodiment 1

Figure 1:
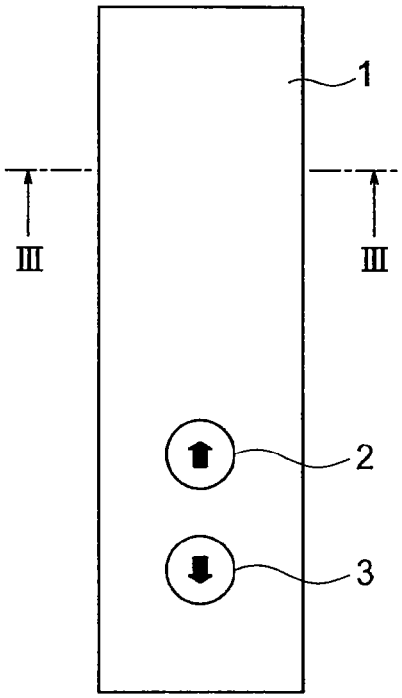
FIG. 1 is a front elevation that shows a state when a landing operating panel according to Embodiment 1 of the present invention is unlit.
Figure 2:
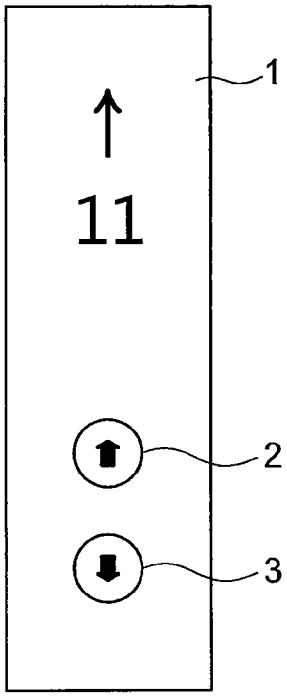
FIG. 2 is a front elevation that shows a state when the landing operating panel from FIG. 1 is lit.
Figure 3:
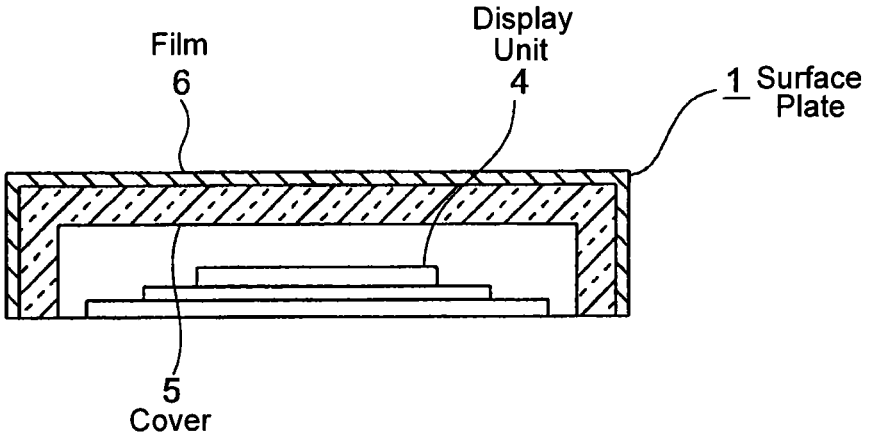
FIG. 3 is a cross section that is taken along line III-III in FIG. 1.

FIG. 1 is a front elevation that shows a state when a landing operating panel according to Embodiment 1 of the present invention is unlit, FIG. 2 is a front elevation that shows a state when the landing operating panel from FIG. 1 is lit, and FIG. 3 is a cross section that is taken along line III-III in FIG. 1.

In the figure, a surface plate 1 is disposed on a front surface of a landing operating panel. An upward call button 2 and a downward call button 3 for registering calls are disposed on the surface plate 1. A plurality of light-emitting display units 4 are disposed behind the surface plate 1. The light-emitting display units 4 are disposed so as to line up vertically. The respective light-emitting display units 4 have a plurality of light sources (light-emitting diodes (LEDs), etc.), and display direction of car movement (arrows) or car position (floor numbers), etc., by emitting light.

The surface plate 1 has: a resin cover (a base resin) 5; and a metallic tone film 6 that is disposed on a front surface of the cover 5. The cover 5 is disposed in front of the light-emitting display units 4 so as to cover the light-emitting display units 4, and transmits the light from the light-emitting display units 4. In this example, the cover 5 is constituted by a resin that is not completely transparent, but that is toned smoke gray, and transmits the light from the light-emitting display units 4 at a predetermined ratio. The light-emitting display units 4 face a back surface of the cover 5 so as to be spaced apart from it.

The metallic tone film 6 is insert molded into or affixed to the cover 5. The metallic tone film 6 is made of a nano-layered film that is optically designed so as to have a metallic sheen (and texture), and transmits the light from the light-emitting display units 4. In other words, the metallic tone film 6 transmits the light from the light-emitting display units 4 at a predetermined ratio while reflecting external light, like a semitransparent mirror.

A polyester film in which several hundred to several thousand heterologous polymer layers that have individually controlled layer thicknesses are stacked with high precision ("PICASUS" (product name) manufactured by Toray Industries, Inc., for example) can be used as such the metallic tone film 6.

If a cover 5 that has comparatively high light transmittance (i.e., that is close to transparent) is used, then it is preferable to use a metallic tone film 6 that has a lower light transmittance. Conversely, if a metallic tone film 6 that has a lower light transmittance is used, then it is preferable to use a cover 5 that has a comparatively high light transmittance, and in that case the cover 5 may also be transparent. If a metallic tone film 6 that has a comparatively high light transmittance (that is closer to transparent) is used, then it is preferable to use a cover 5 that has a lower light transmittance. By selecting such a combination, the light from the light-emitting display units 4 can be transmitted toward the landing while bringing the overall texture of the surface plate 1 close to that of metal.

In a landing operating panel of this kind, because the metallic tone film 6 that transmits the light from the light-emitting display units 4 is disposed on the front surface of the cover 5, windowed printing is not performed and the entire decorative design surface can be given a metallic tone uniformly, enabling decorative design to be improved while enabling cost reductions.

The metallic tone film 6 will not peel or split and is superior in durability compared to when vapor deposited films are used, making it also suitable for display devices that have buttons 2 and 3, as do landing operating panels.

In addition, in elevator display devices, since the content that is displayed by a single light-emitting display unit 4 often changes, as it does in car position displays, it is necessary to increase the window portions when windowed printing is performed, and boundary lines of the window portions are visible, reducing decorative design. However, in the configuration according to Embodiment 1, windowed printing is not required, and boundary lines are not visible, making it particularly effective in elevator display devices in which displayed content changes.

In the configuration according to Embodiment 1, since windowed printing is not performed, the entire surface plate 1 is able to transmit light. Because of this, parts inside the landing operating panel can be seen from outside the landing operating panel by shining a strong light on an outer side or an inner side of the surface plate 1. Thus, confirmation of the presence or absence of pinching of wiring during installation, confirmation of switch settings, etc., can be performed, enabling installation and maintenance to be improved.

In Embodiment 1, because a smoke gray cover 5 is used, a sheen and feel of stainless steel can be imparted to the surface plate 1. A sheen and feel of aluminum can also be imparted to the surface plate 1 by using a smoke gray cover 5 and matt finishing the surface of the metallic tone film 6.

Embodiment 2

Figure 4:
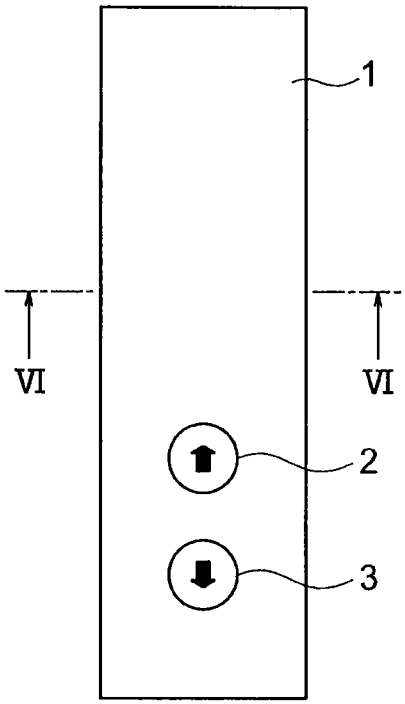
FIG. 4 is a front elevation that shows a state when a landing operating panel according to Embodiment 2 of the present invention is unlit.
Figure 5:
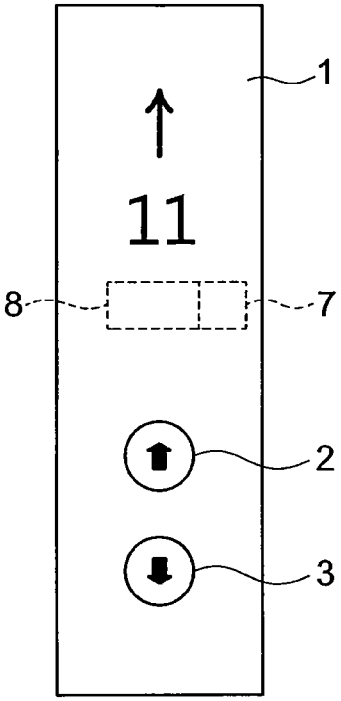
FIG. 5 is a front elevation that shows a state when the landing operating panel from FIG. 4 is lit.
Figure 6:
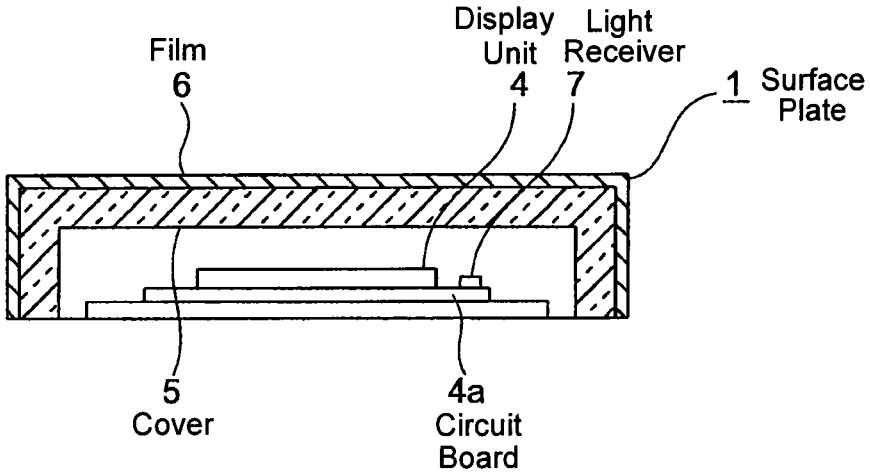
FIG. 6 is a cross section that is taken along line VI-VI in FIG. 4.

Next, FIG. 4 is a front elevation that shows a state when a landing operating panel according to Embodiment 2 of the present invention is unlit, FIG. 5 is a front elevation that shows a state when the landing operating panel from FIG. 4 is lit, and FIG. 6 is a cross section that is taken along line VI-VI in FIG. 4.

In the figures, a remote controller light-receiving portion (a remote controller light-receiving element) 7 that receives an optical signal from a remote controller (not shown) that is disposed outside the landing operating panel is disposed in a space behind a cover 5. In this example, the remote controller light-receiving portion 7 is disposed on a circuit board 4*a* of a light-emitting display unit 4. A remote controller operational state display portion 8 that performs a light-emitting display in response to a light-receiving state of the optical signal at the remote controller light-receiving portion 7 is also disposed on the light-emitting display unit 4. The rest of the configuration is similar or identical to that of Embodiment 1.

In a landing operating panel of this kind, infrared light from the remote controller is transmitted through the metallic tone film 6 and the cover 5 from the landing and is input to the remote controller light-receiving portion 7. Equipment inside the landing operating panel or other equipment is thereby operated, and the operational state thereof is displayed by light being emitted by the remote controller operational state display portion 8. The light from the remote controller operational state display portion 8 is transmitted to the landing side.

Thus, because the metallic tone film 6 that transmits the light from the light-emitting display unit 4 is disposed on the front surface of the cover 5, not only the light-emitting display unit 4 but also the remote controller light-receiving portion 7 can be disposed in the space behind the cover 5 without having to perform windowed printing. Because of this, the remote controller light-receiving portion 7 can be installed in any position behind the cover 5 without being subjected to constraints on decorative design.

Because the remote controller operational state display portion 8 is disposed on the light-emitting display unit 4, the remote controller operational state display portion 8 can also be disposed in the space behind the cover 5 without having to perform windowed printing. Because of this, the remote controller operational state display portion 8 can be installed in any position behind the cover 5 without being subjected to constraints on decorative design.

Embodiment 3

Figure 7:
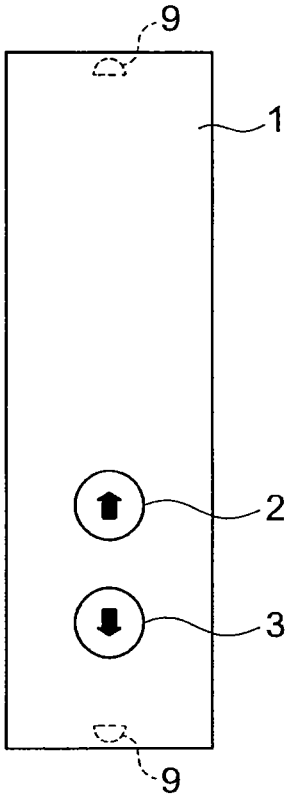
FIG. 7 is a front elevation that shows a state when a landing operating panel according to Embodiment 3 of the present invention is unlit.

Next, FIG. 7 is a front elevation that shows a state when a landing operating panel according to Embodiment 3 of the present invention is unlit. In the figure, a plurality of maintenance lights 9 that illuminate inside of a space behind a cover 5 are disposed in that space. A maintenance light 9 that illuminates downward from an upper end portion inside a landing operating panel, and a maintenance light 9 that illuminates upward from a lower end portion inside the landing operating panel are used in this example. The rest of the configuration is similar or identical to that of Embodiment 1 or 2.

In a landing operating panel of this kind, parts inside the landing operating panel can be seen from outside the landing operating panel by shining a strong light into the space behind a cover 5 using the maintenance lights 9. Thus, confirmation of the presence or absence of pinching of wiring during installation, confirmation of switch settings, etc., can be performed easily, enabling installation and maintenance to be improved.

Moreover, in Embodiment 3, the maintenance lights 9 are not limited in number or position, and can be disposed at any position at which visual confirmation is required. For example, maintenance lights 9 may also be disposed at four corners of the space behind the cover 5, or disposed only on the upper end portion, or disposed only on the lower end portion.

In Embodiments 1 through 3, the color of the cover 5 is not limited to smoke gray, and may also be brown, for example.

In addition, in Embodiments 1 through 3, separate to a matt finish such as that described above, a surface treatment such as hairlining, for example, may also be applied to the metallic tone film 6.

Furthermore, a landing operating panel is shown in the above examples, but the present invention can also be applied to car operating panels, or position indicators that are installed in a car or on a landing, for example. Because of this, the displayed contents of the light-emitting display unit 4 are not limited to direction of movement or position of a car, and various modifications are possible. The present invention can also be applied to cases in which a single light-emitting display unit 4 always performs switching on and off of an identical character.

The invention claimed is:

1. An elevator display device comprising:

a light-emitting display unit;

a resin cover that is disposed in front of the light-emitting display unit so as to cover the light-emitting display unit, and that transmits light from the light-emitting display unit; and a metallic tone film that is disposed on the cover, that is made of a nano-layered film that is optically designed to have a metallic sheen, and that transmits the light from the light-emitting display unit.

2. The elevator display device according to claim 1, wherein the cover is smoke gray in color.

3. The elevator display device according to claim 2, wherein a surface of the metallic tone film is matt finished.

4. The elevator display device according to claim 1, further comprising a remote controller light-receiving portion inside a space behind the cover, the remote controller light-receiving portion receiving an optical signal from a remote controller that is disposed externally.

5. The elevator display device according to claim 4, wherein a remote controller operational state display portion that performs a light-emitting display in response to a light-receiving state of the optical signal at the remote controller light-receiving portion is disposed on the light-emitting display unit.

6. An elevator display device comprising:

a light-emitting display unit;

a resin cover that is disposed in front of the light-emitting display unit so as to cover the light-emitting display unit, and that transmits light from the light-emitting display unit;

a metallic tone film that is disposed on the cover, that is made of a nano-layered film that is optically designed to have a metallic sheen, and that transmits the light from the light-emitting display unit; and a maintenance light that illuminates inside a space behind the cover.

* * * * *